US009920767B2

(12) United States Patent
Klain et al.

(10) Patent No.: US 9,920,767 B2
(45) Date of Patent: Mar. 20, 2018

(54) WELL PUMP SYSTEM

(75) Inventors: Gavriel Klain, Mazkeret Batiya (IL); Avraham Zacharin, Magshemim (IL); Gennadi Heifetz, Rishon le Zion (IL); Igor Kolodin, Kfar Saba (IL)

(73) Assignee: MEKOROT WATER COMPANY, LTD, Tel-Aviv (IL)

( * ) Notice: Subject to any disclaimer, the term of this patent is extended or adjusted under 35 U.S.C. 154(b) by 916 days.

(21) Appl. No.: 14/238,111

(22) PCT Filed: Aug. 9, 2012

(86) PCT No.: PCT/IL2012/050302

§ 371 (c)(1),
(2), (4) Date: Feb. 10, 2014

(87) PCT Pub. No.: WO2013/021387

PCT Pub. Date: Feb. 14, 2013

(65) Prior Publication Data

US 2014/0199159 A1 Jul. 17, 2014

Related U.S. Application Data

(60) Provisional application No. 61/522,041, filed on Aug. 10, 2011.

(51) Int. Cl.
*F04D 29/06* (2006.01)
*F04B 47/06* (2006.01)
(Continued)

(52) U.S. Cl.
CPC ..... *F04D 29/061* (2013.01); *F04B 47/06* (2013.01); *F04D 13/10* (2013.01); *F04D 15/0022* (2013.01)

(58) Field of Classification Search
CPC ..... F04D 13/08; F04D 13/10; F04D 15/0005; F04D 15/0022; F04D 29/044;
(Continued)

(56) References Cited

U.S. PATENT DOCUMENTS 1,494,714 A 5/1924 Schleyer
2,082,996 A * 6/1937 Wintroath ..... F04D 9/007 415/146

(Continued)

FOREIGN PATENT DOCUMENTS

JP 57-49099 A 3/1982

OTHER PUBLICATIONS

International Search Report for International Application No. PCT/IL2012/050302, three pages, dated Oct. 29, 2012.

*Primary Examiner* — Gregory Anderson
*Assistant Examiner* — Julian Getachew
(74) *Attorney, Agent, or Firm* — Vorys, Sater, Seymour & Pease LLP

(57) ABSTRACT

Provided is a well pump system that includes a pressure pipe, a rotatable shaft surrounded by a plurality of bearings, a pumping mechanism mounted to the pressure pipe and having a plurality of pump impellers mounted to a second end of the shaft, a rotating mechanism mounted to a first end of the shaft and configured for rotating it within the bearings, thereby causing the pump impellers to move the fluid in the pressure pipe, and at least one non-return valve configured for assuming at least two states including a first, opened state, in which the second pipe chamber is in fluid communication with the first pipe chamber, and a second, closed state, in which the non-return valve obstructs the fluid communication between the first and the second pipe chambers, thereby lubricating them.

14 Claims, 3 Drawing Sheets

(51) Int. Cl.
*F04D 13/10* (2006.01)
*F04D 15/00* (2006.01)

(58) Field of Classification Search
CPC .... F04D 29/046; F04D 29/047; F04D 29/061; F04D 9/007; F04B 47/00; F04B 47/02; F04B 47/06; F04B 49/22
USPC ..... 137/515, 528, 540, 542
See application file for complete search history.

(56) References Cited

U.S. PATENT DOCUMENTS

| | | | | |
|---|---|---|---|---|
| 2,267,459 | A | 12/1941 | Hait | |
| 2,491,751 | A | 12/1949 | McGee | |
| 2,688,929 | A | 9/1954 | Schleyer | |
| 2,818,814 | A | 1/1958 | Woods | |
| 2,821,933 | A | 2/1958 | Brennan | |
| 3,807,894 | A | 4/1974 | O'Rourke | |
| 4,021,137 | A | 5/1977 | Zehren | |
| 4,453,892 | A | 6/1984 | Brookbank, III | |
| 4,669,953 | A | 6/1987 | Gschwender | |
| 4,932,846 | A | 6/1990 | Valentine | |
| 6,004,096 | A | 12/1999 | Young | |
| 8,336,632 | B2 * | 12/2012 | Morrow | E21B 43/126 166/105 |

* cited by examiner

WELL PUMP SYSTEM

FIELD OF THE INVENTION

The presently disclosed subject matter relates to a well pump system. Specifically, the presently disclosed subject matter is concerned with lubrication of bearings in a well pump system.

BACKGROUND OF THE DISCLOSED SUBJECT MATTER

Deep well pumps were an important factor in increasing the water supply in remote areas. The invention of the deep well pump became a technological breakthrough in the water supply industry. Water from the well is necessary for individuals living in areas where communal water systems remain unavailable. A deep well pump must be used so that they can pump water from the ground. A deep well pump also called as vertical turbine pump can be a multistage centrifugal pump with a shaft operated by a surface motor that lifts water from small-diameter, deep wells. When the shaft is rotate by the motor, a pumping mechanism which is disposed within the fluid is rotated, and as a result of that, fluid is drawn upwards through a pressure pipe in which the shaft is rotated.

One known problem in the field of well pump systems is the need to periodically or constantly lubricate the bearings in which a shaft is rotated. Lubrication is a process, or technique employed to reduce wear of one or both surfaces in close proximity, and moving relative to each another, by interposing a substance called lubricant between the surfaces to carry or to help carry the load (pressure generated) between the opposing surfaces. The interposed lubricant film can be liquid, or any other suitable substance. One example of a lubricant used in well pump systems is oil (e.g., a machine oil) which is periodically or constantly provided into the clearance between the bearings and the rotating shaft.

SUMMARY OF THE DISCLOSED SUBJECT MATTER

The presently disclosed subject matter, in its one aspect, provides a well pump system comprising: a pressure pipe having a vertical axis; a rotatable shaft extending within the pressure pipe along the vertical axis and surrounded by a plurality of bearings exposed to interior of the pressure pipe, the shaft having a first end and a second end; a pumping mechanism mounted to the pressure pipe and having a plurality of pump impellers mounted to the second end of the shaft, the pumping mechanism being configured for being at least partially submerged within a fluid located within a well; a rotating mechanism mounted to the first end of the shaft and configured for rotating it within the bearings, thereby causing the pump impellers to move the fluid in the pressure pipe at least from the second end to the first end of the shaft; and at least one non-return valve mounted around the shaft between the first and the second ends thereof, dividing the pressure pipe into a first pipe chamber associated with the rotating mechanism and a second pipe chamber, the non-return valve being configured for assuming at least two states: a first, opened state, in which the second pipe chamber is in fluid communication with the first pipe chamber allowing to build therein a column of fluid in fluid communication with at least a part of the bearings disposed within the first pipe chamber thereby lubricating them, and a second, closed state, in which the column of fluid applies a pressure on the non-return valve, thereby causing the non-return valve to obstruct the fluid communication between the first and the second pipe chambers while keeping at least a part of the bearings disposed within the first pipe chamber in fluid communication with the column of fluid, thereby lubricating them.

The above well pump system is a fluid-lubricated system which can be operated without using specially designated oil (such as machine oil) as a lubricant that lubricates the bearings in which the shaft of the well pump system is rotated. The lubrication of the bearings can be provided by constantly or periodically causing the bearings to be in contact with the pumped fluid, while the fluid is pumped and while it is not pumped by the system. For example, by using the well pump system above, all the bearings can be in fluid communication with the pumped fluid in the opened state and/or in the closed state of the non-return valve.

When the operation of the rotating mechanism is terminated, the non-return valve can be configured to assume the closed state as a response to a fluid pressure applied thereon by a fluid flow from the first pipe chamber to the second pipe chamber.

The non-return valve can comprise: a housing, a first valve chamber in fluid communication with the first pipe chamber, a second valve chamber in fluid communication with the second pipe chamber, a sliding element mounted in the housing. The sliding element can be configured to form with the housing an external passage between the first and second valve chambers, and with the shaft an internal passage between the first and second valve chambers.

The sliding member can be movable along the vertical axis between an uppermost position corresponding to the opened state of the non-return valve in which the external and internal passages are open for fluid communication between the first and second valve chambers, and thereby between the first and the second pipe chambers, and a lowermost position corresponding to the closed position of the non-return valve, in which the external and internal passages are closed, and there is no fluid communication between the first and second valve chambers and thereby between the first and second pipe chambers.

If in the closed state of the non-return valve, there is still passage of fluid through the internal and/or the external passages from the first to the second pipe chambers, fluid from an external source can be added into the first pipe chamber, so that a substantially constant level of fluid is preserved within the first pipe chamber. By keeping this constant level of fluid, all the bearing within the first pipe chamber will be continuously lubricated in the closed state of the non-return valve.

The sliding member can be movable between the uppermost and lowermost positions as a result of a fluid pressure exerted thereon by fluid flow in corresponding upward and downward directions along the vertical axis.

The shaft can be provided with an annular element sealably mounted thereon and having an upper support, and the sliding element can be provided with an internal shoulder configured to sealingly abut the upper support in the lowermost position of the sliding element, thereby closing the internal passage in the closed state of the non-return valve, and to be spaced therefrom in the uppermost position, thereby opening the internal passage in the opened state of the non-return valve.

The sliding element can be provided with an internal seal configured to be sealingly disposed between the internal shoulder and the upper support in the lowermost position of the sliding element.

Optionally, in the uppermost position of the sliding element, there is no contact between the internal seal and the shaft, and in the lowermost position of the sliding element, the internal seal can be configured to be deformed between the internal shoulder and the upper support, such that a sealed contact with the shaft is provided.

The housing can be provided with a housing shoulder having a housing seal and the sliding element can be provided with an external shoulder having an external seal configured to sealingly abut the housing seal in the lowermost position of the sliding element, thereby closing the external passage in the closed state of the non-return valve, and to be spaced from the housing seal in the uppermost position of the sliding element, thereby opening the external passage in the opened state of the non-return valve.

The housing can be provided with a first housing bearing and a second housing bearing, both extending within the housing and configured to support the sliding element and to allow its movement therebetween.

The annular element can be axially movable along the shaft, and it can be sealably mounted on the shaft via at least one o-ring disposed therebetween.

In the uppermost position of the sliding element, the annular element can be configured to slide along the shaft towards the internal shoulder as a result of a fluid pressure applied by a fluid being pumped, and during the assumption of the lowermost position of the sliding element, the annular element can be configured to slide along the shaft towards the second housing bearing, and to lean on the second bearing in the lowermost position.

In the opened state of the non-return valve, the shaft can be configured to freely rotate within the non-return valve with the annular element mounted thereon.

The sliding element can be connected to the first housing bearing via a spring. This spring can be configured to stabilize the sliding element by applying a pulling force thereon when the sliding element is in the lowermost position.

The plurality of bearings can comprise an extremity bearing which is proximal to the second end of the shaft, and the non-return valve can be disposed between the extremity bearing and the pumping mechanism.

According to another aspect of the presently disclosed subject matter there is provided a non-return valve for use with a well pump system, comprising: a housing configured to be integrated with a pressure pipe of a well pump system having a vertical axis; a shaft portion mounted within the housing and configured to be integrated with a rotatable shaft extending within the pressure pipe along the vertical axis and surrounded by a plurality of bearings exposed to interior of the pressure pipe, the shaft having a first and a second ends; a first valve chamber configured to correspond to a first pipe chamber of the pressure pipe; a second valve chamber configured to correspond to a second pipe chamber of the pressure pipe; and a sliding element mounted in the housing configured to form with the housing an external passage between the first and second valve chambers, and with the shaft portion an internal passage between the first and second valve chambers. The sliding member can be movable along the vertical axis between an uppermost position corresponding to an opened state of the non-return valve in which the external and internal passages are open for fluid communication between the first and second valve chambers, and thereby between the first and the second pipe chambers while a fluid being pumped by a pumping mechanism having a plurality of pump impellers being mounted to the second end of the shaft and operated by a rotating mechanism mounted to the first end for rotating the shaft, and a lowermost position corresponding to a closed position of the non-return valve, in which the external and internal passages are closed, and there is no fluid communication between the first and second valve chambers and thereby between the first and second pipe chambers, while fluid is not pumped by the pumping mechanism.

In the uppermost position of the non-return valve, the second pipe chamber is in fluid communication with the first pipe chamber allowing to build therein a column of fluid in fluid communication with at least a part of the bearings disposed within the first pipe chamber thereby lubricating them, and wherein in the lowermost position the column of fluid applies a pressure on the sliding element, thereby causing the it to obstruct the fluid communication between the first and the second pipe chambers while keeping at least a part of the bearings disposed within the first pipe chamber in fluid communication with the column of fluid, thereby lubricating them.

The shaft portion can be provided with an annular element sealably mounted thereon and having an upper support, and the sliding element is provided with an internal shoulder configured to sealingly abut the upper support in the lowermost position of the sliding element, thereby closing the internal passage in the closed state of the non-return valve, and to be spaced therefrom in the uppermost position, thereby opening the internal passage in the opened state of the non-return valve.

In the uppermost position of the sliding element, there can be no contact between the internal seal and the shaft portion, and in the lowermost position of the sliding element, the internal seal can be configured to be deformed between the internal shoulder and the upper support, such that a sealed contact with the shaft portion is provided.

The housing can be provided with a housing shoulder having a housing seal and the sliding element can be provided with an external shoulder having an external seal configured to sealingly abut the housing seal in the lowermost position of the sliding element, thereby closing the internal passage in the closed state of the non-return valve, and to be spaced from the housing seal in the uppermost position of the sliding element, thereby opening the external passage in the opened state of the non-return valve.

The annular element can be axially movable along the shaft portion, and it can be sealably mounted on the shaft portion via at least one o-ring disposed therebetween.

In the uppermost position of the sliding element, the annular element can be configured to slide along the shaft portion towards the first housing bearing as a result of a fluid pressure applied by a fluid being pumped, and during the assumption of the lowermost position of the sliding element, the annular element can be configured to slide along the shaft towards the second bearing, and to lean on the second housing bearing in the lowermost position.

In the opened state of the non-return valve, the shaft portion can be configured to freely rotate within the non-return valve with the annular element mounted thereon.

According to a still further aspect of the presently disclosed subject matter, there is provided a well pump system comprising: a pressure pipe having a vertical axis; a shaft extending along the vertical axis between a first end and a second end thereof; a pumping mechanism mounted to the pressure pipe and having a plurality of pump impellers mounted to the second end of the shaft, the pumping mechanism being configured for being at least partially submerged within a fluid located within a well; at least one non-return valve mounted around the shaft between the first and the second ends thereof, dividing the pressure pipe into a first pipe chamber associated with the first end and a second pipe chamber associated with the second end, the non-return valve being configured for assuming at least two states: a first, opened state, in which the second pipe chamber is in fluid communication with the first pipe chamber to allow fluid from the second pipe chamber to fill the first pipe chamber when the pumping mechanism is operative by rotation of the pump impellers, and a second, closed state in which the fluid communication between the first and the second pipe chamber is obstructed by pressure applied thereon by fluid left in the first pipe chamber when the pumping mechanism is inoperative; a plurality of bearings surrounding the shaft at least in the first pipe chamber, the bearings being located between the first end and the non-return valve and being exposed to interior of the first pipe chamber for their lubrication by fluid in the first pipe chamber in both the opened and the closed states; and a rotating mechanism connected to the first end of the shaft and configured for rotating it within the bearings, thereby causing the pump impellers to move the fluid in the pressure pipe at least from the second pipe chamber to the first pipe chamber.

According to a still further aspect of the presently disclosed subject matter, there is provided a method of lubricating a plurality of bearings in a well pump system comprising: a pressure pipe having a vertical axis; a shaft extending along the vertical axis between a first end and a second end thereof; a pumping mechanism mounted to the pressure pipe and having a plurality of pump impellers mounted to the second end of the shaft; a plurality of bearings surrounding the shaft at least in the first pipe chamber and being located between the first end and the non-return valve and exposed to interior of the first pipe chamber; a rotating mechanism connected to the first end of the shaft; and at least one non-return valve mounted around the shaft between the first and the second ends thereof, dividing the pressure pipe into a first pipe chamber associated with the rotating mechanism and a second pipe chamber, the method comprising steps of:

at least partially submerging the pumping mechanism within a fluid located within a well;

rotating the shaft by the rotating mechanism, thereby causing the plurality of pump impellers to move the fluid in the pressure pipe at least from the second pipe chamber to the first pipe chamber;

bringing the non-return valve to an opened state, in which the second pipe chamber is in fluid communication with the first pipe chamber, thereby allowing fluid from the second pipe chamber to fill the first pipe chamber;

lubricating the bearings by the fluid within the first pipe chamber in the opened state of the non-return valve;

terminating the operation of the rotating mechanism, thereby causing the pumping mechanism to stop pumping the fluid;

bringing the non-return valve to a closed state, thereby obstructing the fluid communication between the first and second pipe chambers by pressure applied on the non-return valve by fluid left in the first pipe chamber; and lubricating the bearings by the fluid within the first pipe chamber in the closed state of the non-return valve.

According to a still further aspect of the presently disclosed subject matter, there is provided a method of constructing a well pump system and using it for lubricating a plurality of bearings in a well pump system comprising: a pressure pipe having a vertical axis; a shaft extending along the vertical axis between a first end and a second end thereof; a pumping mechanism mounted to the pressure pipe and having a plurality of pump impellers mounted to the second end of the shaft; a plurality of bearings surrounding the shaft at least in the first pipe chamber and being located between the first end and the non-return valve and exposed to interior of the first pipe chamber; and a rotating mechanism connected to the first end of the shaft and configured for rotating it within the bearings to operate the pumping mechanism to move the fluid in the pressure pipe at least from the second pipe chamber to the first pipe chamber, the method comprising steps of:

mounting a non-return valve within a well pump system around the shaft between the first and the second ends thereof, thereby dividing the pressure pipe into a first pipe chamber associated with the first end and a second pipe chamber associated with the second end;

at least partially submerging the pumping mechanism within a fluid located within a well;

operating the pumping mechanism by causing the rotating mechanism to rotate said shaft with the pump impellers within the fluid;

bringing the non-return valve to an opened state, in which the second pipe chamber is in fluid communication with the first pipe chamber, thereby allowing fluid from the second pipe chamber to fill the first pipe chamber;

lubricating the bearings by the fluid within the first pipe chamber in the opened state of the non-return valve;

bringing the pumping mechanism to an inoperative state by terminating the rotation of the shaft;

bringing the non-return valve to a closed state, thereby obstructing the fluid communication between the first and second pipe chambers by pressure applied on the non-return valve by fluid left in the first pipe chamber; and lubricating the bearings by the fluid within the first pipe chamber in the closed state of the non-return valve.

According to different aspects of the presently disclosed subject matter, the non-return valve can be provided as being a foot valve.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
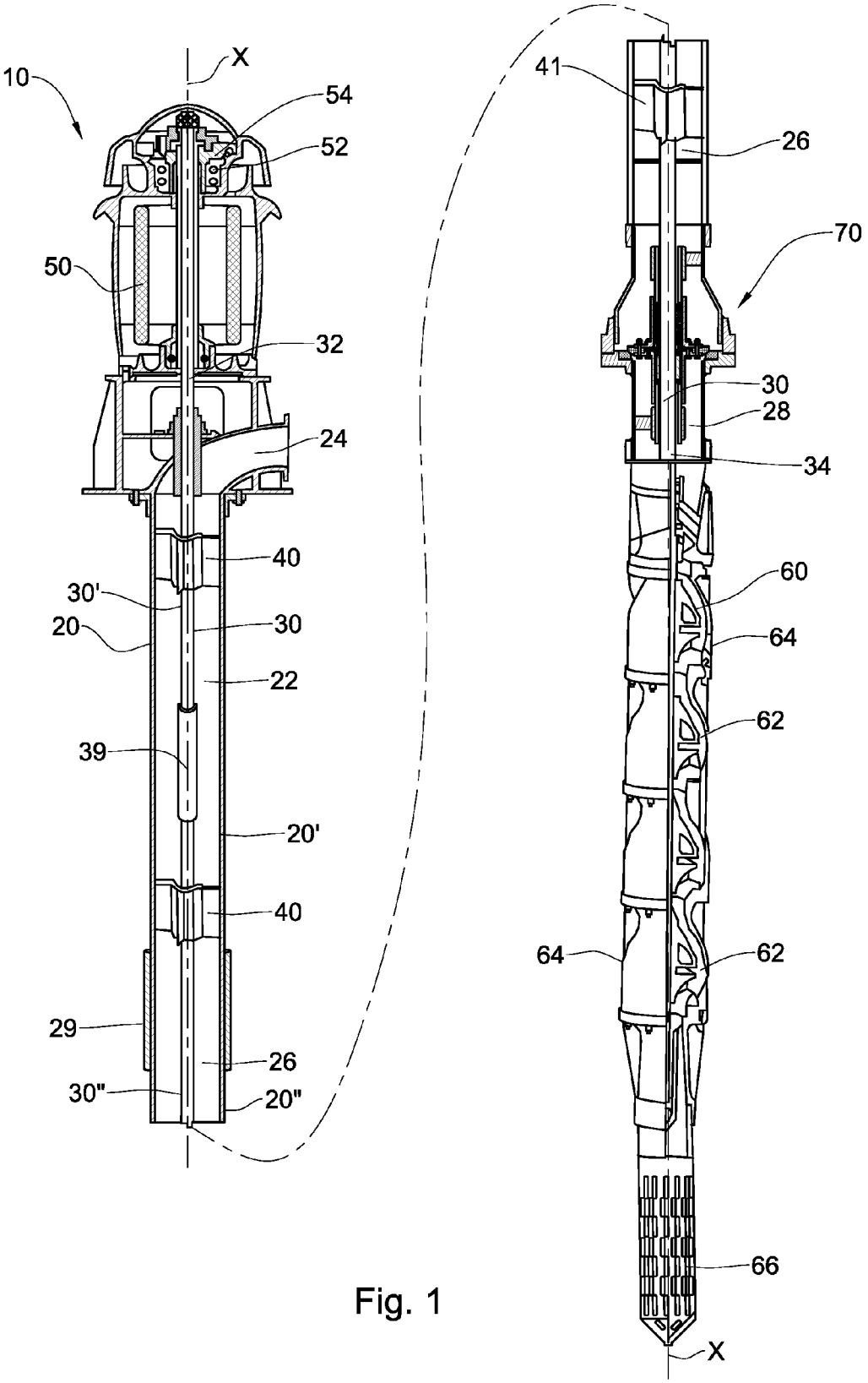
FIG. 1 illustrates a cross-sectional view a well pump system according to one example of the presently disclosed subject matter. The pumping mechanism that is shown in this figure is presented with a partially cross-sectional view and partially a perspective view for purposes of illustration.

Attention is first directed to FIG. 1 which illustrates one example of a well pump system 10, according to the presently disclosed subject matter. As generally shown in FIG. 1, the well pump system 10 comprises a pressure pipe 20 having a vertical axis X, and a rotatable shaft 30 extending within the pressure pipe 20 along the axis X. The rotatable shaft 30 has a first end 32 and a second end 34, and is surrounded by a plurality of bearings 40 which are exposed to an interior section 22 of the pressure pipe 20. The bearings 40 can be made of a flexible material as rubber.

The well pump system 10 comprises a rotating mechanism 50 (e.g., a motor) mounted to the first end 32 of the shaft 30, and a pumping mechanism 60 having a plurality of pump impellers 62 mounted to the second end 34 of the shaft 30 and disposed within a pump housing 64. The shaft 30 is configured to transfer the transmission force from the rotating mechanism 50 to the pump impellers 62 of pumping mechanism 60. Prior to its operation, the well pump system 10 is inserted into an elongated bore of a well (not shown) having a fluid (e.g., water) therein. In order to pump the fluid from the well, the pumping mechanism 60 is submerged within this fluid, so that during the process of pumping, the rotating mechanism 50 rotates the shaft 30 together with the pump impellers 62, and as a result of that fluid is drawn and pumped into the pump housing 64 through a suction basket 66. Following this, the fluid passes through the interior section 22 of the pressure pipe 20, and escapes from the pressure pipe 20 via a pipe opening 24. The suction basket 66 has grooves which are configured to filter the pumped fluid, so that large particles that can strike the operation of the system will not enter into the pumping mechanism 60.

The first end 32 of the shaft 30 is disposed within a pressure bearing 52 which has angular contact points intended to carry the shaft's load, including the pump impellers 62, and to provide safe and quiet operation of the system. The first end 32 of the shaft 30 is connected to a non-return belt (i.e., a ratchet) 54 which is installed in order to prevent undesired reverse rotation of the shaft 30 and the pump impellers 62 which may be caused by flow of returning fluid after the termination of the operation of the rotating mechanism 50.

The pressure pipe 20 and the shaft 30 are constructed of separate elements which are connected to each other during the installment of the system within the well. For example, the pressure pipe 20 can be assembled of pressure pipe elements 20' and 20", each having a length of 300 cm, which are connected to each other by a pipe connector 29 (e.g., cylinder screwing, flanges), and the shaft 30 can be assembled of shaft elements 30' and 30", each having a length of 300 cm, which are connected to each other by a shaft connector 39 (e.g., clampings).

During the rotation of the shaft 30, the bearings 40 which are disposed along the pressure pipe 20, and around the shaft 30, can prevent violent vibration of the shaft 30 which can be a result of a combination of high rotative speed, torsion and tension. The bearings 40 can be welded or otherwise suitably secured to interior wall of the pressure pipe 20. For proper operation of the system, and more specifically, for the rotation of the shaft 50 within the pressure pipe 20, the bearings 40 have to be constantly lubricated. According to the presently disclosed subject matter, the bearings 40 are lubricated by the pumped fluid itself, and not by any other external lubricants (such as machine oil). In order to lubricate the bearings 40 by the pumped fluid, there is a need to preserve them in fluid communication with the pumped fluid not only when the system is operative and the fluid passes therethrough, but also when the system is inoperative and the pumped fluid flows back into the well and the pressure pump becomes empty.

The water-lubricated well pump system of the presently disclosed subject matter can be used in wells having a depth of more than 150 meter, in which usually oil lubricated well pump systems are used. By using the water-lubricated well pump system of the presently disclosed subject matter, the use of oil is prevented. Therefore, the use of a well pump system which does not implement oil for lubrication has advantages such as: lubricating oil can pollute the pumped fluid with microbes that accumulate therein; lubricating oil can be accumulated within fluid storages, and there will be a need to extract it from the fluid.

In order to preserve the bearings 40 in continuous fluid communication with the pumped fluid, a non-return valve 70 is mounted into the well pump system 10. The non-return valve 70 can be disposed around the shaft 30 between the first and the second ends thereof, and more specifically between a lowermost bearing 41 and the pumping mechanism 60. When the non-return valve 70 is mounted within the pressure pipe, it divides the pressure pipe 20 into a first pipe chamber 26 associated with rotating mechanism 50 and a second pipe chamber 28. The lowermost bearing 41 is a bearing selected from the plurality of bearings 40, and is the most proximal to the second end 34 of the shaft 30.

The non-return valve 70 is configured to assume two states: a first, opened state (shown for example in FIG. 2), in which the second pipe chamber 28 is in fluid communication with the first pipe chamber 26 allowing to build therein a column of fluid, and a second, closed state (shown for example in FIG. 3), in which the column of fluid applies pressure on the non-return valve 70, thereby causing the non-return valve 70 to obstruct the fluid communication between the first and the second pipe chambers 26 and 28. The non-return valve 70 is configured to assume the opened state while the pumping mechanism 50 is operative and the fluid is pumped, and to assume the closed state while the pumping mechanism 50 is inoperative and the fluid is not pumped from the well.

When the pumping mechanism 60 is operative and the pump impellers 62 are rotated, the non-return valve 70 is in the opened state, and the first pipe chamber 26 is continuously filled with a column of fluid which is being pumped. This column of fluid constantly wets the bearings 40 which are disposed within the first pipe chamber 26, thereby lubricating them. This lubricating fluid is able to enter into the clearance between each one of bearings 40 and the shaft 30. When the operation of the pumping mechanism 60 is terminated, the column of fluid which is disposed above the non-return valve 70, tends to flow back into the well from the first to the second pipe chamber. The flow of this remained fluid into the well applies pressure on the non-return valve 70, causing it to assume the closed state. The details of operation and the components of the non-return valve 70 are presented below with respect to FIGS. 2 and 3. In the closed state of the non-return valve, in which there is no fluid communication between the first and the second pipe chambers 26 and 28, the column of fluid which is left above the non-return valve, is in fluid communication with the bearings 40 which are disposed within the first pipe chamber 26, thereby wetting and lubricating them. The integration of the non-return valve 70 within the well pump system 10, results in constant existence of fluid above the non-return valve 70, in both, its opened and the closed states. This fluid is constantly wetting the bearings 40 which are disposed in the first pipe chamber 26, and thereby used as a lubricating substance which lubricates them.

By using a well pump system with the non-return valve 70, there is an advantage of keeping a substantially constant pressure of fluid above the pumping mechanism. This feature of the presently disclosed subject matter provides stable conditions for the pumping mechanism 60 in order to begin the pumping operation, and prevents during activation and deactivation of the pumping operation sudden actuation of forces on the impellers of the pumping mechanism.

Figure 2:
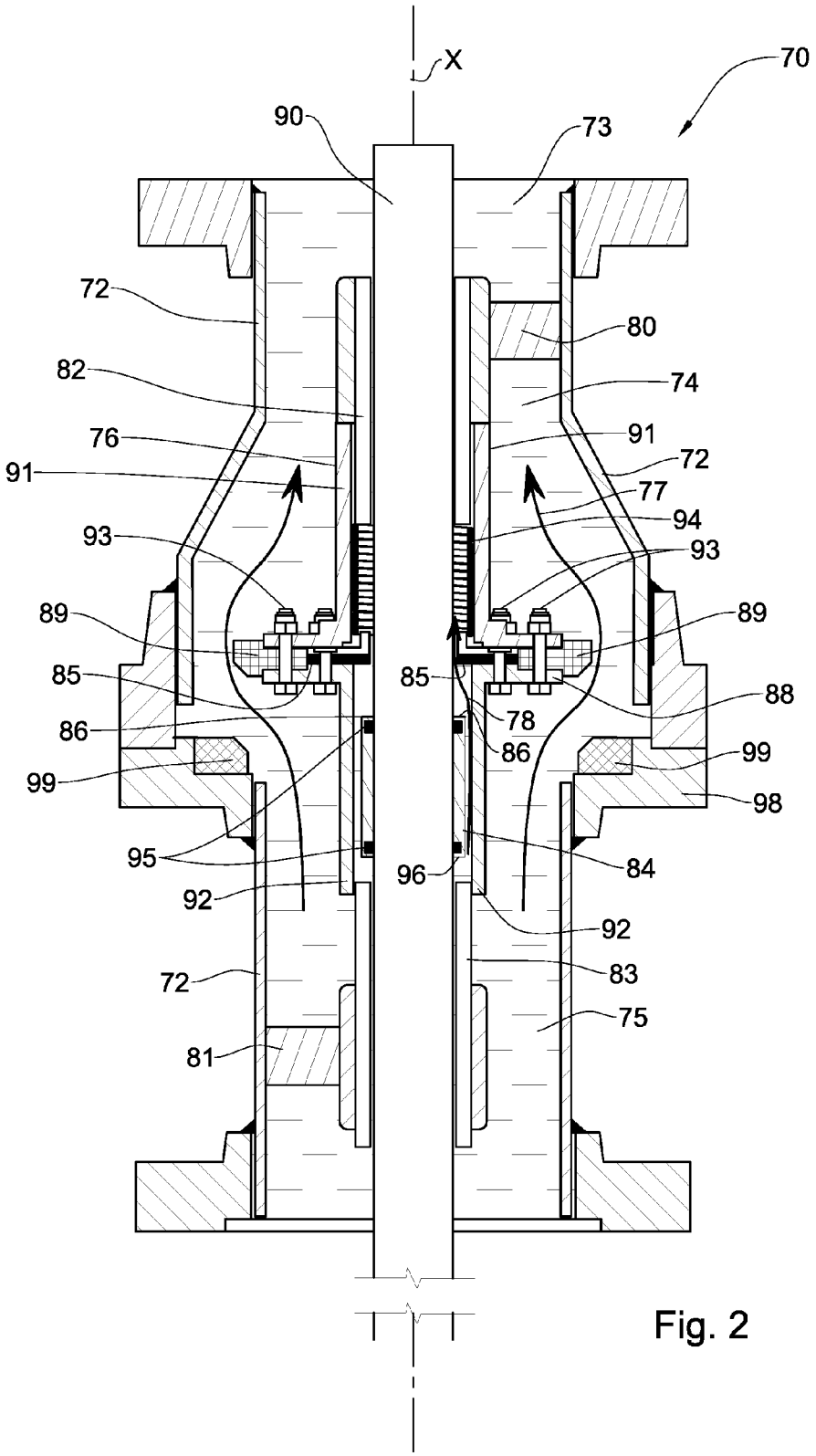
FIG. 2 illustrates a cross-sectional view a non-return valve, in its opened state, according to one example of the presently disclosed subject matter.
Figure 3:
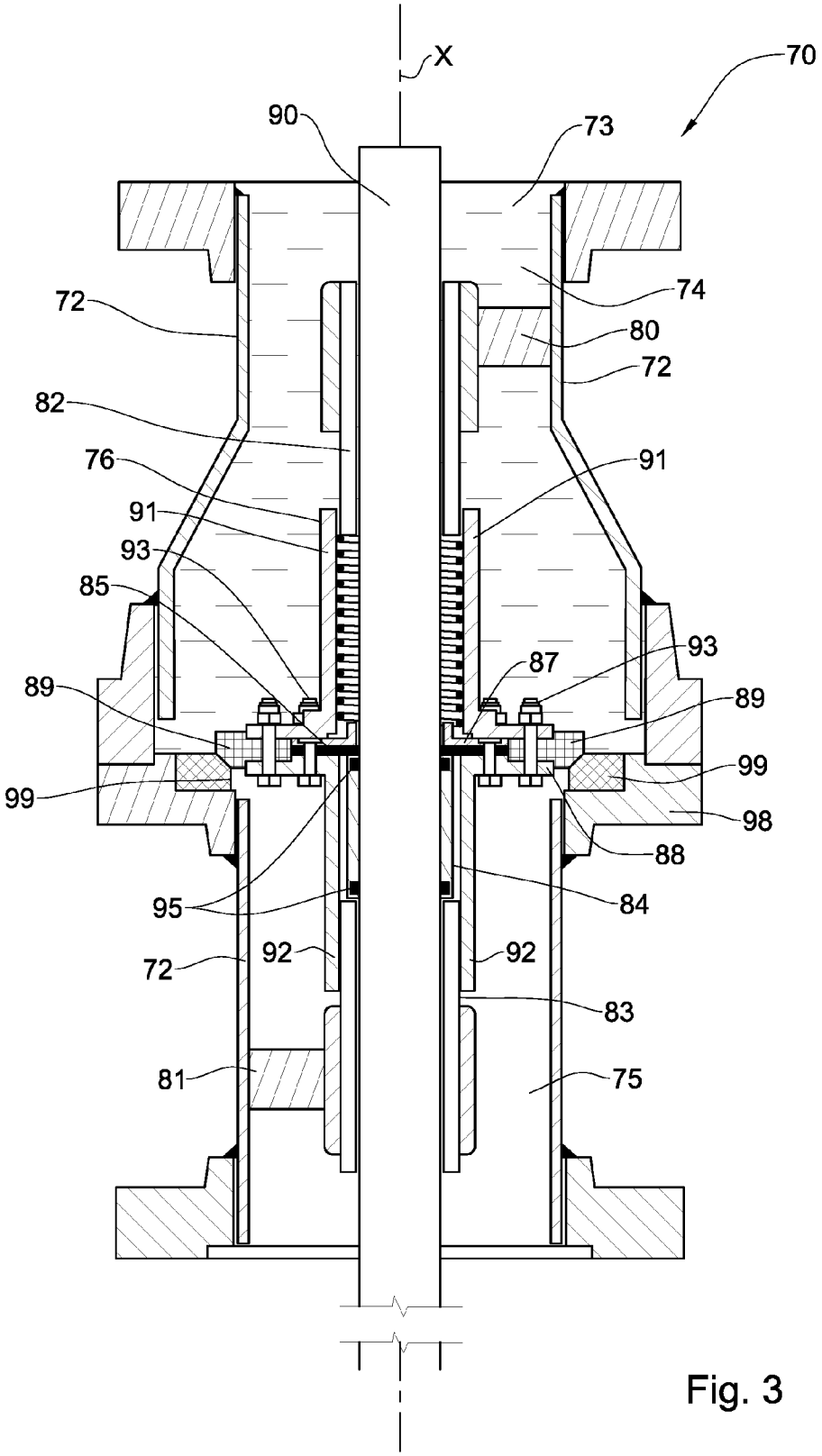
FIG. 3 illustrates a cross-sectional view a non-return valve, in its closed state, according to one example of the presently disclosed subject matter.

Attention is now made to FIGS. 2 and 3 which illustrate the non-return valve 70 in a detailed manner in its opened and closed states, respectively. The non-return valve 70 is formed of a housing 72 which has a valve interior section 73 disposed therein. The valve interior section 73 is divided into two chambers: a first valve chamber 74 and a second valve chamber 75. When the non-return valve 70 is integrated within the well pump system 10, the first valve chamber 74 is in fluid communication with the first pipe chamber 26, and the second valve chamber 75 is in fluid communication with the second pipe chamber 28. The non-return valve 70 has a first housing bearing 80, a second housing bearing 81, and a sliding element 76 mounted therebetween. These bearings are configured to support the sliding element 76, and to allow its movement therebetween. The first housing bearing 80 is provided with a first rail 82, and the second housing bearing 81 is provided with a second rail 83. The sliding element 76 is seated on the first and the second rails 82 and 83, and is able to slide thereon between the opened and closed states of the non-return valve 70.

The non-return valve is configured to accommodate a shaft portion 90 which can be a separate bridging element that interconnects two portions of the shaft 30, or it can be provided as an integral portion of the shaft 30. Although the reference numbers of the shaft and the shaft portion are different, they can refer to same element.

The sliding element 76 forms with the housing 72 an external passage 77 between the first and second valve chambers 74 and 75, and with the shaft portion 90 an internal passage 78 between these valve chambers. During the operation of the system, the pumped fluid can pass at the same time through the external and internal passages 77 and 78 towards the pipe opening 24. The reason for the existence of the internal passage 77 is the requirement for a free rotation of the shaft within the non-return valve, which requires a clearance between the shaft portion 90 and the elements of the non-return valve 70. This clearance forms the internal passage 77.

The sliding member 76 is movable along the vertical axis X between two positions: an uppermost position which is illustrated in FIG. 2, and a lowermost position which is illustrated in FIG. 3. The uppermost position of the sliding member is corresponding to the opened state of the non-return valve 70 in which the external and internal passages 77 and 78 are open for fluid communication between the first and second valve chambers 74 and 75, and thereby between the first and the second pipe chambers 26 and 28. The lowermost position is corresponding to the closed position of the non-return valve 70, in which the external and internal passages 77 and 78 are closed, and there is no fluid communication between the first and second valve chambers 74 and 75, and thereby between the first and second pipe chambers 26 and 28. The movement of the sliding element 76 between the uppermost and the lowermost positions is provided according to this flow direction of the fluid within the pressure pipe 20, and more specifically within the housing 72. When the fluid is pumped by the system, it passes through the non-return valve 70 while applying pressure of the sliding element 76, and causing it to move in the upward direction along the axis X to the uppermost position. When the pumping process is terminated, the fluid which is disposed above the sliding element 76 applies pressure on the sliding element 76, causing it the move in the downward direction along the axis X to the lowermost position.

The shaft portion 90 is provided with an annular element 84 which is sealably mounted thereon and having an upper support 86 and a lower support 96. During the operation of the system, the shaft portion 90 is freely rotatable within the non-return valve 70, and more specifically within the sliding element 76, with the annular element 84 mounted thereon. The housing 72 is provided with a housing shoulder 98 having a housing seal 99. The sliding element 76 is provided with an internal shoulder 87 having an internal seal 85, and an external shoulder 88 having an external seal 89.

The sliding element 76 is constructed of two main elements: an upper element 91 and a lower element 92 which are connected to each other by screws 93, so that the internal shoulder 87, the internal seal 85, and the external seal 89 are fixed therebetween.

As shown in FIG. 2, when the sliding element 76 is positioned in the uppermost position (corresponding to the opened state of the non-return valve), the internal shoulder 87 is spaced from the upper support 86 of the annular element 84, the lower support 96 is spaced from the second rail 83, and the internal seal 85 is spaced from the shaft portion 90, thereby opening the internal passage 77 to allow passage of fluid therethrough. In this uppermost position of the sliding element 76, the external seal 89 of the external shoulder 88 is spaced from the housing seal 99 of the housing shoulder 98, thereby opening the external passage 77 to allow passage of fluid therethrough.

As shown in FIG. 3, when the sliding element 76 is positioned in the lowermost position (corresponding to the closed state of the non-return valve), the internal shoulder 87 sealingly abuts the upper support 86 of the annular element 84 while the lower support 96 leans on the second rail 83, so that internal passage 78 is obstructed and passage of fluid therethrough is prevented. In this position of the internal shoulder 87 with respect to the upper support 86, the internal seal 85 is deformed under the pressure applied on it from its both sides by the internal shoulder 87 and the upper support 86, such that a sealed contact of the internal seal 85 with the shaft is provided. In this lowermost position of the sliding element 76, the external seal 89 of the external shoulder 88 sealingly abuts the the housing seal 99 of the housing shoulder 98, thereby closes the external passage 77 and prevents passage of fluid therethrough.

The annular element 84 is sealably mounted on the shaft portion 90 via two o-rings 95 which are disposed therebetween. The mounting of the annular element 84 with o-rings 95 allows the axial move along the shaft portion 90 between the uppermost and the lowermost positions of the sliding element 76. When the sliding element assumes the lowermost position, the internal seal 85 engages the upper support 86 of the annular element 84, and applies pressure on it. This pressure causes the annular element 84 to slide along the shaft portion 90 in its downward direction until engagement of the lower support 96 with the second rail 83 occurs. The result of this movement of the annular element 84 is shown in FIG. 3 in which the annular element 84 leans on the second rail 83 and is disposed in a position which is lower than its position in FIG. 2. Immediately after the assumption of the uppermost position of the annular element 84, a pressure which is applied on the annular element 84 by the pumped fluid that passes through the internal passage 78, causes the annular element 84 to slide along the shaft portion 90 towards the internal seal 85, and to take its initial position, as shown in FIG. 2.

The sliding element is connected to the first rail 82 of the first bearing 80 via a spring 94. This spring is configured to stabilize the sliding element 76 by applying a pulling force thereon when the sliding element 76 is in the lowermost position. This pulling force of the spring 94 is opposite to the force which is applied by the column of fluid which is disposed above the sliding element 76 in the lowermost position. The summation of these forces results in a precise pressure which is applied on the different sealing elements of the system (such as, the internal seal 85, the external seal 89, and the housing seal 99), so that sealing is provided in all the needed locations and between all the sealing elements at the same time.

The invention claimed is:

1. A well pump system, comprising:

a pressure pipe having a vertical axis;

a rotatable shaft extending within said pressure pipe along said vertical axis and surrounded by a plurality of bearings exposed to an interior of the pressure pipe, the shaft having a first end and a second end and comprises an annular element sealably mounted thereon and having an upper support;

a pumping mechanism mounted to said pressure pipe and comprising a plurality of pump impellers mounted to said second end of the shaft, said pumping mechanism being configured for being at least partially submerged within a fluid located within a well;

a rotating mechanism mounted to said first end of the shaft and configured for rotating it within said bearings, thereby causing said pump impellers to move the fluid in said pressure pipe at least from the second end to the first end of the shaft; and at least one non-return valve mounted around the shaft between the first and the second ends thereof, dividing said pressure pipe into a first pipe chamber associated with said rotating mechanism and a second pipe chamber;

wherein said non-return valve comprises: a housing; a first valve chamber in fluid communication with the first pipe chamber; a second valve chamber in fluid communication with the second pipe chamber; and a sliding element mounted in said housing, said sliding element configured to form with said housing an external passage between said first and second valve chambers, and with said shaft an internal passage between the first and second valve chambers; and wherein said sliding element is movable along said vertical axis between an uppermost position corresponding to a first, opened state, of the non-return valve in which said external and internal passages are open for fluid communication between said first and second valve chambers, and thereby between the first and the second pipe chambers allowing to build therein a column of fluid in fluid communication with at least a part of the bearings disposed within the first pipe chamber thereby lubricating said at least a part of the bearings, and a lowermost position corresponding to a second, closed state, of the non-return valve, in which said external and internal passages are closed, and there is no fluid communication between the first and second valve chambers and thereby between the first and second pipe chambers while keeping said at least a part of the bearings disposed within the first pipe chamber in fluid communication with the column of fluid, thereby lubricating said at least a part of the bearings;

wherein the sliding element comprises an internal shoulder configured to sealingly abut the upper support in said lowermost position of the sliding element, and to be spaced therefrom in said uppermost position; and wherein said non-return valve further comprises an internal seal configured to be sealingly disposed between said internal shoulder and said upper support in said lowermost position of the sliding element.

2. The well pump system according to claim 1, wherein in said opened state or in said closed state, all said plurality of bearings are configured to be in fluid communication with fluid.

3. The well pump system according to claim 1, wherein when said rotation of the shaft is terminated, said non-return valve is configured to assume the closed state as a response to a fluid pressure applied thereon by a fluid flow from the first pipe chamber to the second pipe chamber.

4. The well pump system according claim 1, wherein the sliding element is movable between the uppermost and lowermost positions as a result of a fluid pressure exerted thereon by fluid flow in corresponding upward and downward directions along said vertical axis.

5. The well pump system according to claim 1, wherein in said uppermost position of the sliding element, there is no contact between the internal seal and the shaft, and in said lowermost position of the sliding element, said internal seal is configured to be deformed between the internal shoulder and the upper support, such that a sealed contact with the shaft is provided.

6. The well pump system according to claim 1, wherein said housing is provided with a housing shoulder having a housing seal and the sliding element is provided with an external shoulder having an external seal configured to sealingly abut the housing seal in said lowermost position of the sliding element, thereby closing the external passage in said closed state of the non-return valve, and to be spaced from the housing seal in the uppermost position of the sliding element, thereby opening the external passage in the opened state of the non-return valve.

7. The well pump system according to claim 1, wherein said housing is provided with a first housing bearing and a second housing bearing, both extending within said housing and configured to support the sliding element and to allow its movement therebetween.

8. The well pump system according to claim 1, wherein in the opened state of the non-return valve, the shaft is configured to freely rotate within the non-return valve with the annular element mounted thereon.

9. A non-return valve for use with a well pump system, comprising:

a housing configured to be integrated with a pressure pipe of a well pump system having a vertical axis;

a shaft portion mounted within said housing and configured to be integrated with a rotatable shaft extending within said pressure pipe along said vertical axis and surrounded by a plurality of bearings exposed to an interior of the pressure pipe, said rotatable shaft having a first and a second end;

an annular element sealably mounted on said shaft portion and having an upper support;

a first valve chamber configured to correspond to a first pipe chamber of the pressure pipe;

a second valve chamber configured to correspond to a second pipe chamber of the pressure pipe; and a sliding element mounted in the housing configured to form with said housing an external passage between the first and second valve chambers, and with said shaft portion an internal passage between the first and second valve chambers, wherein said sliding element is movable along said vertical axis between an uppermost position corresponding to an opened state of the non-return valve in which the external and internal passages are open for fluid communication between the first and second valve chambers, and thereby between the first and the second pipe chambers while a fluid is pumped by a pumping mechanism having a plurality of pump impellers being mounted to said second end of the rotatable shaft and operated by a rotating mechanism mounted to said first end for rotating the rotatable shaft, and a lowermost position corresponding to a closed position of the non-return valve, in which the external and internal passages are closed, and there is no fluid communication between the first and second valve chambers and thereby between the first and second pipe chambers, while fluid is not pumped by the pumping mechanism, wherein the sliding element is provided with an internal shoulder configured to sealingly abut the upper support in said lowermost position of the sliding element, and to be spaced therefrom in said uppermost position, and wherein said non-return valve further comprises an internal seal configured to be sealingly disposed between said internal shoulder and said upper support in said lowermost position of the sliding element.

10. The non-return valve according to claim 9, wherein in said uppermost position of the non-return valve, said second pipe chamber is in fluid communication with said first pipe chamber allowing to build therein a column of fluid in fluid communication with at least a part of the bearings disposed within the first pipe chamber thereby lubricating them, and wherein in said lowermost position the column of fluid applies a pressure on the sliding element, thereby causing it to obstruct the fluid communication between the first and the second pipe chambers while keeping at least a part of the bearings disposed within the first pipe chamber in fluid communication with the column of fluid, thereby lubricating them.

11. The non-return valve according to claim 9, wherein in said uppermost position of the sliding element, there is no contact between the internal seal and the shaft portion, and in said lowermost position of the sliding element, said internal seal is configured to be deformed between the internal shoulder and the upper support, such that a sealed contact with the shaft portion is provided.

12. The non-return valve according to claim 9, wherein said housing is provided with a housing shoulder having a housing seal and the sliding element is provided with an external shoulder having an external seal configured to sealingly abut the housing seal in said lowermost position of the sliding element, thereby closing the internal passage in said closed state of the non-return valve, and to be spaced from the housing seal in the uppermost position of the sliding element, thereby opening the external passage in the opened state of the non-return valve.

13. The non-return valve according to claim 9, wherein said plurality of bearings comprises an extremity bearing which is proximal to the second end of the rotatable shaft, said non-return valve being disposed between the extremity bearing and the pumping mechanism.

14. A method of lubricating a plurality of bearings in a well pump system comprising:

a pressure pipe having a vertical axis;

a rotatable shaft extending along said vertical axis between a first end and a second end thereof having an annular element sealably mounted thereon and having an upper support;

a rotating mechanism connected to said first end of the shaft, and at least one non-return valve mounted around the shaft between the first and the second ends thereof, dividing said pressure pipe into a first pipe chamber associated with said rotating mechanism and a second pipe chamber, said non-return valve comprising a housing, a first valve chamber in fluid communication with the first pipe chamber, a second valve chamber in fluid communication with the second pipe chamber, a sliding element mounted in said housing, and an internal seal, said sliding element configured to form with said housing an external passage between said first and second valve chambers, and with said shaft an internal passage between the first and second valve chambers, said sliding element comprising an internal shoulder and is movable along said vertical axis between an uppermost position corresponding to an opened state of the non-return valve, and a lowermost position corresponding to a closed state of the non-return valve, in which said external and internal passages are closed, a pumping mechanism mounted to said pressure pipe and having a plurality of pump impellers mounted to said second end of the shaft, a plurality of bearings surrounding said shaft at least in said first pipe chamber and being located between said first end and the non-return valve and exposed to interior of said first pipe chamber, the method comprising steps of:

at least partially submerging said pumping mechanism within a fluid located within a well;

rotating said shaft by said rotating mechanism, thereby causing said plurality of pump impellers to move the fluid in said pressure pipe at least from the second pipe chamber to the first pipe chamber;

bringing the non-return valve to said opened state, in which said second pipe chamber is in fluid communication with said first pipe chamber, thereby allowing fluid from the second pipe chamber to fill the first pipe chamber;

lubricating the bearings by the fluid within said first pipe chamber in said opened state of the non-return valve;

terminating said rotation of the shaft, thereby causing the pumping mechanism to stop pumping said fluid;

bringing the non-return valve to said closed state by moving the sliding element to its lowermost position, thereby causing the internal shoulder to sealingly abut the upper support and said internal seal to be sealingly disposed between the internal shoulder and the upper support, thereby obstructing the fluid communication between the first and second pipe chambers by pressure applied on the non-return valve by fluid left in the first pipe chamber; and lubricating the bearings by the fluid within said first pipe chamber in said closed state of the non-return valve.

* * * * *